US011512851B2

(12) United States Patent
Home

(10) Patent No.: US 11,512,851 B2
(45) Date of Patent: Nov. 29, 2022

(54) WICK-BURNING AND VENTILATION AND FLOW-GUIDE STRUCTURE

(71) Applicant: LOVINFLAME, INC., Taipei (TW)

(72) Inventor: William Home, Taipei (TW)

(73) Assignee: LOVINFLAME, INC., Taipei (TW)

( * ) Notice: Subject to any disclaimer, the term of this patent is extended or adjusted under 35 U.S.C. 154(b) by 203 days.

(21) Appl. No.: 17/105,644

(22) Filed: Nov. 27, 2020

(65) Prior Publication Data

US 2022/0170628 A1 Jun. 2, 2022

(51) Int. Cl.
*F23D 3/24* (2006.01)

(52) U.S. Cl.
CPC ..... *F23D 3/24* (2013.01)

(58) Field of Classification Search
CPC .... F21S 13/12; F23D 3/24; F23D 3/18; F23D 2900/31
See application file for complete search history.

(56) References Cited

U.S. PATENT DOCUMENTS 125,672 A * 4/1872 Fowler ..... F23D 3/00 431/314
373,195 A * 11/1887 Requa ..... F23D 3/00 431/312
576,641 A * 2/1897 Weston ..... F23D 3/00 431/313
1,087,280 A * 2/1914 Coons ..... F23D 3/00 431/313
1,732,708 A * 10/1929 Withrow ..... F21L 17/00 431/314
4,110,066 A * 8/1978 Murphy ..... F21S 13/00 431/125
4,234,303 A * 11/1980 Neugart ..... F23B 7/00 431/291
5,669,767 A * 9/1997 Bureau ..... F23D 3/24 422/305
5,807,093 A * 9/1998 Tendick, Sr. ..... F21V 37/00 431/146
6,231,336 B1 * 5/2001 Chen ..... F23D 3/16 362/163

(Continued)

FOREIGN PATENT DOCUMENTS

AU 2004224977 A1 * 11/2004 ..... F23D 3/08
CA 2363739 C * 10/2009 ..... F21S 13/12

(Continued)

*Primary Examiner* — Jorge A Pereiro
(74) *Attorney, Agent, or Firm* — Leong C. Lei

(57) ABSTRACT

A wick-burning and ventilation and flow-guide structure includes a wick tray, a heat isolation cover, and a wick. The heat isolation cover has support sections that are extended to form protrusion sections insertable into and mounted in mounting holes of the wick tray for secured combination and easy separation. The wick tray and the heat isolation cover provide a dual-layered heat isolation effect and also achieve an effect of heat dissipation. The wick is made of a metallic or ceramic material and has a surface over which a flame-blocking heat-isolating sleeve is fit to prevent downward spreading of flaming. A wind-shielding hood is provided on the fuel container to define therebetween a flow-guide opening for smooth ingress of air, preventing flaming from jumping.

6 Claims, 9 Drawing Sheets

(56) References Cited

U.S. PATENT DOCUMENTS

| | | | | |
|---|---|---|---|---|
| 6,537,063 | B1 * | 3/2003 | Pecoskie | F21V 37/007 431/324 |
| 7,156,653 | B1 * | 1/2007 | DeMars | F23D 3/24 431/324 |
| 10,119,702 | B2 * | 11/2018 | Fendler | F23D 3/18 |
| 2003/0027092 | A1 * | 2/2003 | Wolgamuth | F23D 3/24 431/345 |
| 2003/0054312 | A1 * | 3/2003 | Lee | F23D 3/18 431/289 |
| 2005/0239010 | A1 * | 10/2005 | Duska | F23D 3/30 431/288 |
| 2014/0087318 | A1 * | 3/2014 | Chen | F23D 3/18 431/325 |
| 2014/0248572 | A1 * | 9/2014 | Chen | F23D 3/18 431/320 |
| 2016/0046889 | A1 * | 2/2016 | Tyson | C11C 5/002 44/275 |
| 2021/0048190 | A1 * | 2/2021 | Wu | F23D 3/02 |

FOREIGN PATENT DOCUMENTS

| | | | | | |
|---|---|---|---|---|---|
| CN | 203177166 | U | * | 9/2013 | C11C 5/006 |
| CN | 111351036 | A | * | 6/2020 | F23D 3/02 |
| DE | 3405824 | C2 | * | 12/1993 | F21S 13/00 |
| DE | 4314122 | A1 | * | 11/1994 | C11C 5/006 |
| DE | 19637861 | A1 | * | 10/1997 | F21V 37/00 |
| EP | 3671037 | A1 | * | 6/2020 | F23D 3/18 |
| FR | 361409 | A | * | 6/1906 | |
| FR | 2780137 | A1 | * | 12/1999 | F21S 13/12 |
| KR | 100526681 | B1 | * | 11/2005 | |
| WO | WO-9833011 | A1 | * | 7/1998 | F23D 3/08 |

* cited by examiner

WICK-BURNING AND VENTILATION AND FLOW-GUIDE STRUCTURE

TECHNICAL FIELD OF THE INVENTION

The present invention relates to a wick-burning and ventilation and flow-guide structure, and more particularly to a wick-burning and ventilation and flow-guide structure that provide excellent properties concerning burning security, heat isolation, heat dissipation, prevention of over-heating, and stabilized and jumping-free flame.

DESCRIPTION OF THE PRIOR ART

Candles have been used as a lighting device since the ancient time. Candles that are available in the market, as well as lanterns or heaters that burn alcohol or kerosene, often use a cotton-based wick for fuel burning and flaming such a process of fuel burning results in high temperature carbonization that gives off a large amount of PM2.5 particles, causing pollution to the atmosphere and generating odor smell. Further, the cotton-based wick is consumed by the burning process and requires constant replacement, and this would need a great number of wicks.

Apparently, the traditional cotton-based wick that is generally provided for burning or flaming would generate issues of environmental pollution and does not provide cleaning burning and suffers poor security, poor isolation of heat, and poor heat dissipation, and would thus generate the issue of consumption of a lot of wicks.

Further, for a burning device that is equipped with a wick, during the burning of the wick, care must be taken to ensure the wick is firmly positioned in an upright condition and falling and inclining of the wick must be avoided in order to ensure security of burning, and also, heat isolation and heat dissipation must be taken into consideration in order to prevent events of over-heating.

Further, without being installed with a wind-shield hood, during the burning of a wick, the flame may become unstable due to being influenced by airflows or winds, leading to jumping of the flame.

In view of the above, the present invention aims to provide a solution that helps overcome the drawbacks discussed above.

SUMMARY OF THE INVENTION

An objective of the present invention is to provide a wick-burning and ventilation and flow-guide structure that features excellent burning security, good heat isolation, good heat dissipation, and preventing over-heating.

To achieve the above objective, the present invention comprises a wick tray, a heat isolation cover, and a wick, wherein the wick tray comprises a recess, the recess being provided with at least one through hole, a bottom of the recess of the wick tray being provided with a plurality of heat-dissipating fuel-dropping holes and at least one mounting hole, the wick tray being positionable on a fuel container; the heat isolation cover is in the form of a curved surface, the heat isolation cover being provided with at least one through aperture, the through aperture corresponding to the through hole, the heat isolation cover having a periphery that is formed with at least one support section corresponding to the mounting hole of the wick tray, the support section being extended to form a protrusion section that is receivable and positioned in the mounting hole, in order to connect the heat isolation cover to the wick tray in a removable manner and also to form a heat isolation space between the heat isolation cover and the wick tray, the periphery of the heat isolation cover being also formed with at least one opening part, which defines, together with a periphery of the wick tray, a ventilation heat-dissipating space; and the wick is made of a metallic or ceramic material, the wick being receivable in and extendible through the through aperture of the heat isolation cover and the through hole of the wick tray to be positioned, a flame-blocking heat-isolating sleeve being fit over and mounted to a surface of the wick between the heat isolation cover and the wick tray.

Advantages that can be achieved are as follows:

The heat isolation cover includes the support section that is extended to form the protrusion section for insertion and disposition in the mounting hole of the wick tray so as to have the heat isolation cover and the wick tray firmly and securely combined together, while enable easy separation or detachment, and that the wick can be firmly and securely supported in an upright manner to improve the safety of burning.

The wick tray and the heat isolation cover together provide a dual-layer heat-isolating effect and also achieve an effect of heat dissipation.

The surface of the wick receives the flame-blocking heat-isolating sleeve to fit thereto so as to ensure flaming or burning will not spread or extend downward to cause over-heating of the wick tray and the fuel container.

Another objective of the present invention is to provide a wick-burning and ventilation and flow-guide structure that makes the flame stable and not jumping.

To achieve the said another objective, the present invention provides a wind-shielding hood that is positionable on the fuel container to surround and shield the wick, the fuel container having an outside surface that is provided with a fuel-container inclination surface, a lower edge of the wind-shielding hood and the fuel-container inclination surface jointly defining a ventilation and flow-guide opening, so that an airflow is allowed to flow through the ventilation and flow-guide opening into the wind-shielding hood in a uniform manner and external winds are prevented from directly blowing onto the wick.

As such, the wind-shielding hood not only provides an effect of shielding the wick from winds, but also enables smooth ingress of air into the wind-shielding hood so as to make flaming on the wick stable and not jumping.

The present invention, as a whole, provides the following beneficial efficacy:

The pollution issue commonly found in the conventional wicks can be resolved, and advantages of clean burning, environment-friendliness, economic and safe, excellent performance of heat isolation and heat dissipation, and no consumption of wick can be achieved.

A detailed description will be provided below with reference to certain embodiments, together with the attached drawings, to provide a better understanding of the features and functionality of the present invention.

DETAILED DESCRIPTION OF THE PREFERRED EMBODIMENT

Figure 1:
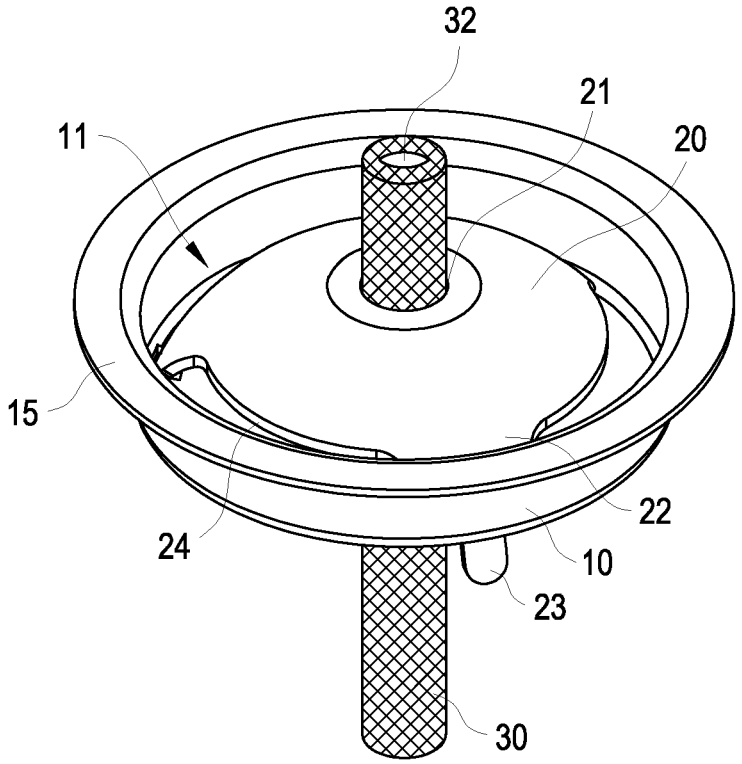
FIG. 1 is a perspective view of the present invention.
Figure 2:
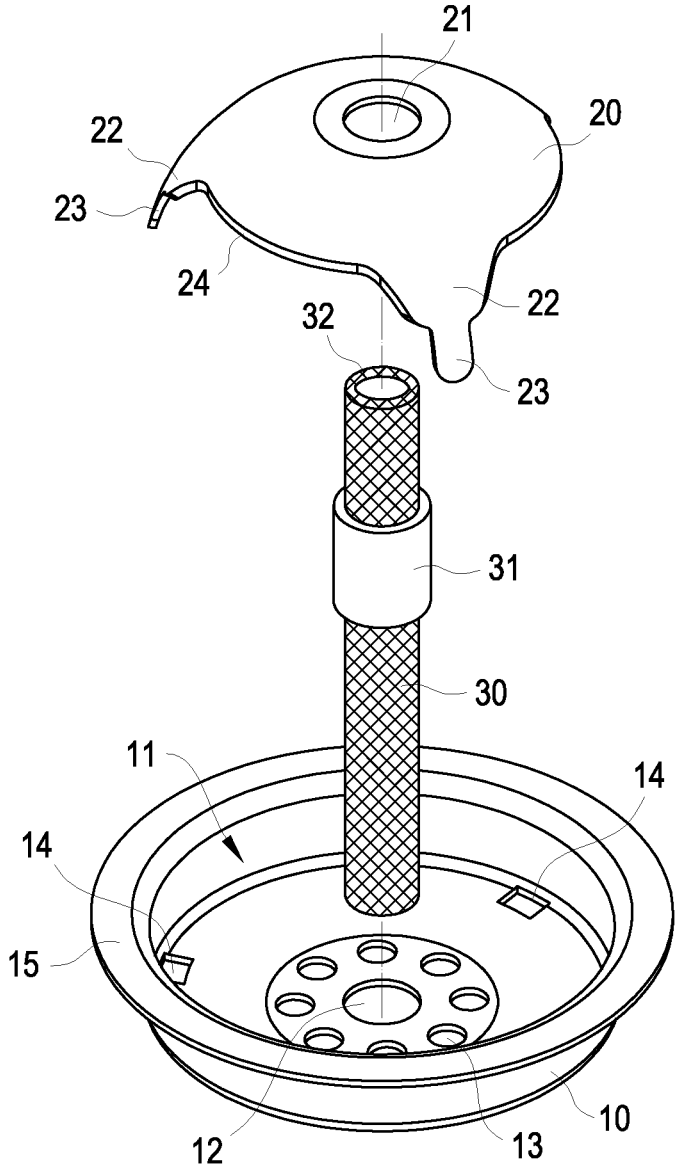
FIG. 2 is an exploded view of the present invention.
Figure 3:
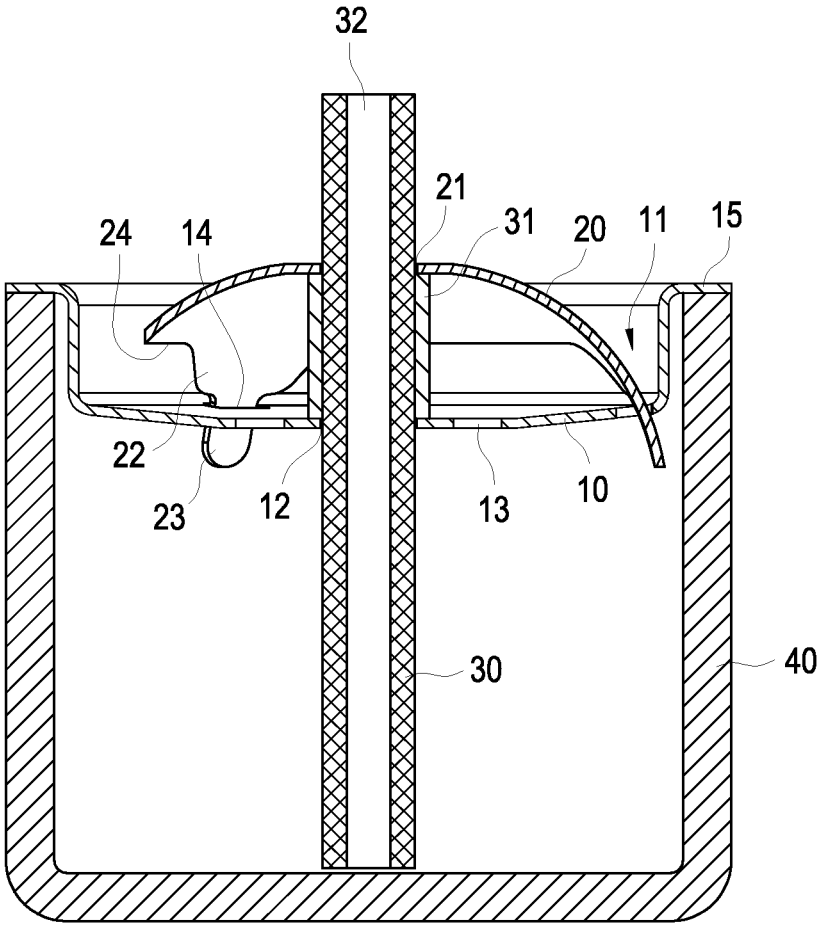
FIG. 3 is a cross-sectional view illustrating an example of use of the present invention.

Referring to FIGS. 1, 2, and 3, the present invention comprises a wick tray 10, a heat isolation cover 20, and a wick 30. Details are provided below:

The instant embodiment is a single-wick embodiment, but it is not intended to limit the number of wicks 30 that can be used in the present invention the wick 30.

The wick tray 10 comprises a recess 11. The recess 11 is provided with at least one through hole 12. A bottom of the recess 11 of the wick tray 10 is provided with a plurality of heat-dissipating fuel-dropping holes 13 and at least one mounting hole 14. The wick tray 10 is positionable on a fuel container 40.

The heat isolation cover 20 is in the form of a curved or arc surface. The heat isolation cover 20 is provided with at least one through aperture 21. The through aperture 21 corresponds to the through hole 12. The heat isolation cover 20 has a periphery that is formed with at least one support section 22 corresponding to the mounting hole 14 of the wick tray 10. The support section 22 is extended to form a protrusion section 23 that is receivable, or insertable, or positionable in the mounting hole 14, in order to connect the heat isolation cover 20 to the wick tray 10 in a removable manner and also to form a heat isolation space between the heat isolation cover 20 and the wick tray 10. The periphery of the heat isolation cover 20 is also formed with at least one opening part 24, which defines, together with a periphery of the wick tray 10, a ventilation heat-dissipating space.

In the embodiment, a plurality of support sections 22 are provided and uniformly arranged at constant intervals so that the heat isolation cover 20 is firmly and stably mounted on the wick tray 10.

The wick 30 is made of a metallic or ceramic material. The wick 30 is received in and extends through the through aperture 21 of the heat isolation cover 20 and the through hole 12 of the wick tray 10 so as to be positioned and a portion of the wick 30 that is located between the heat isolation cover 20 and the wick tray 10 is provided with a flame-blocking heat-isolating sleeve 31 that is fit to a surface of the portion.

In an embodiment, a flange 15 is arranged to extend from a periphery of the wick tray 10, and the flange 15 is positionable, in a straddling manner, on an edge of an opening of the fuel container 40.

In an embodiment, the bottom of the recess 11 of the wick tray 10 is of a curved or arc surface that slopes toward the heat-dissipating fuel-dropping holes 13, in order to guide a liquid fuel to flow toward and thus concentrate in the heat-dissipating fuel-dropping holes 13 to smoothly flow downward to the fuel container 40 located on the underside thereof.

In an embodiment, the opening part 24 of the heat isolation cover 20 is of a curved or arc configuration that protrudes outward.

In an embodiment, a gas passage hole 32 is formed in a central portion of the wick 30. During the burning of the wick 30, the gas passage hole 32 helps extend a flame upward and improves the capillary action or wicking of the wick 30 for increasing the rate of sucking fuel from the fuel container 40 located on the underside (also see FIG. 4).

In an embodiment, the wick 30 is made of a stainless steel or ceramic material.

The above provide an introduction to the components of the present invention and the way of assembly thereof, and in the following, a description will be provided to discuss an example of use of the present invention and the advantages and benefits thereof.

Figure 4:
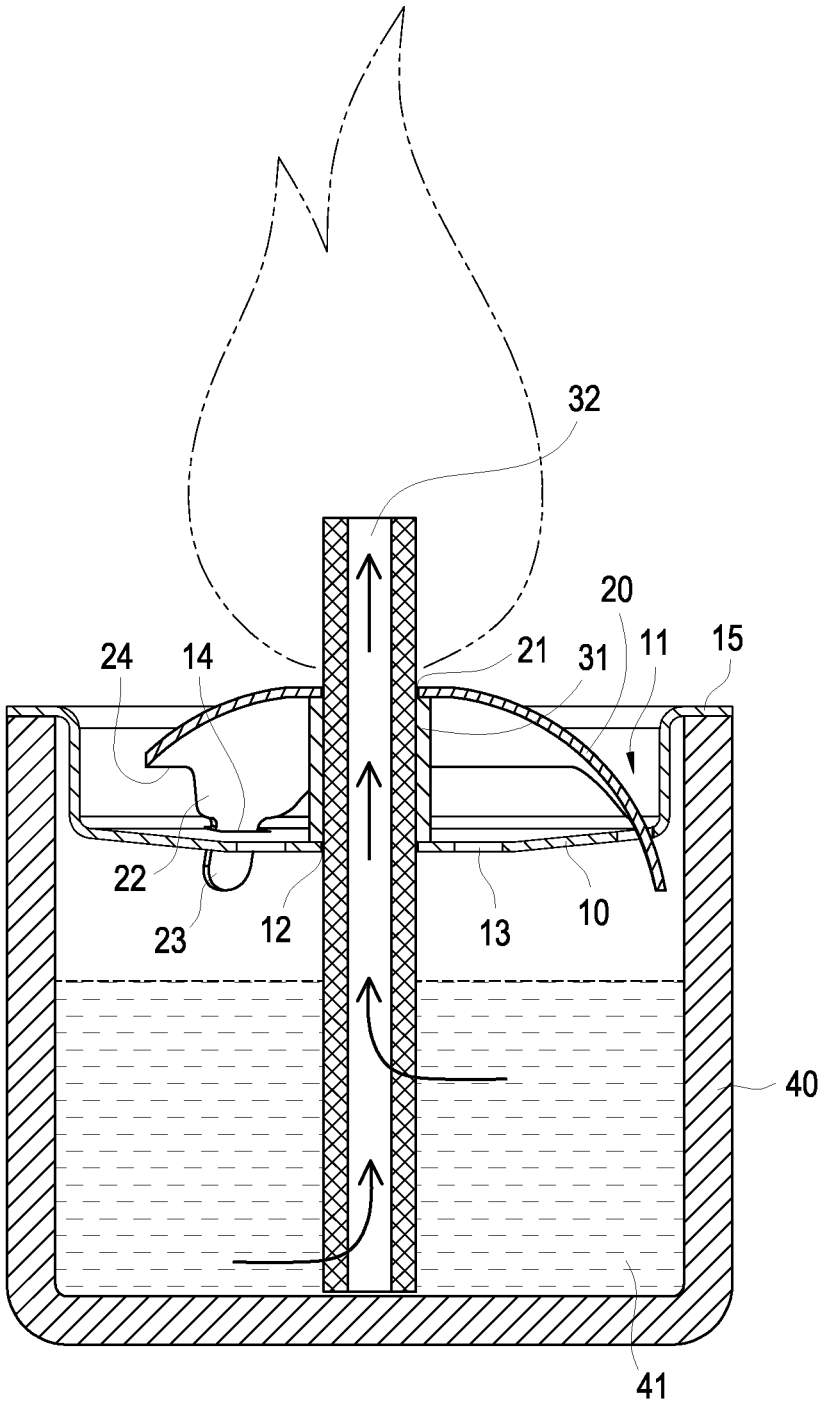
FIG. 4 is another cross-sectional view illustrating the example of use of the present invention.

Referring to FIG. 4, the present invention provides that the wick tray 10 is firmly and stably positioned on the fuel container 40, with a portion of the wick 30 (which may be referred to as a the in-fuel-container portion) being immersed in fuel 41, so that the wick 30 provides a capillary action to suck in the fuel 41 for burning and may persistently maintain such burning for an extended period of time.

It is noted here that the present invention provides the following advantages:

The heat isolation cover 20 includes the support section 22 that is extended to form the protrusion section 23 for insertion and disposition in the mounting hole 14 of the wick tray 10 so as to have the heat isolation cover 20 and the wick tray 10 firmly and securely combined together, while enable easy separation or detachment, and that the wick 30 can be firmly and securely supported in an upright manner to improve the safety of burning.

The wick tray 10 and the heat isolation cover 20 together provide a dual-layer heat-isolating effect, and the ventilation heat-dissipating space formed thereby and the opening part 24 of the heat isolation cover 20 achieve an effect of heat isolation and heat dissipation.

The surface of the wick 30 receives the flame-blocking heat-isolating sleeve 31 to fit thereto so as to ensure flaming or burning will not spread or extend downward to cause over-heating of the wick tray 10 and the fuel container 40.

The present invention, as a whole, provides the following beneficial efficacy:

The pollution issue commonly found in the conventional wicks can be resolved, and advantages of clean burning, environment-friendliness, economic and safe, excellent performance of heat isolation and heat dissipation, and no consumption of wick can be achieved.

Figure 5:
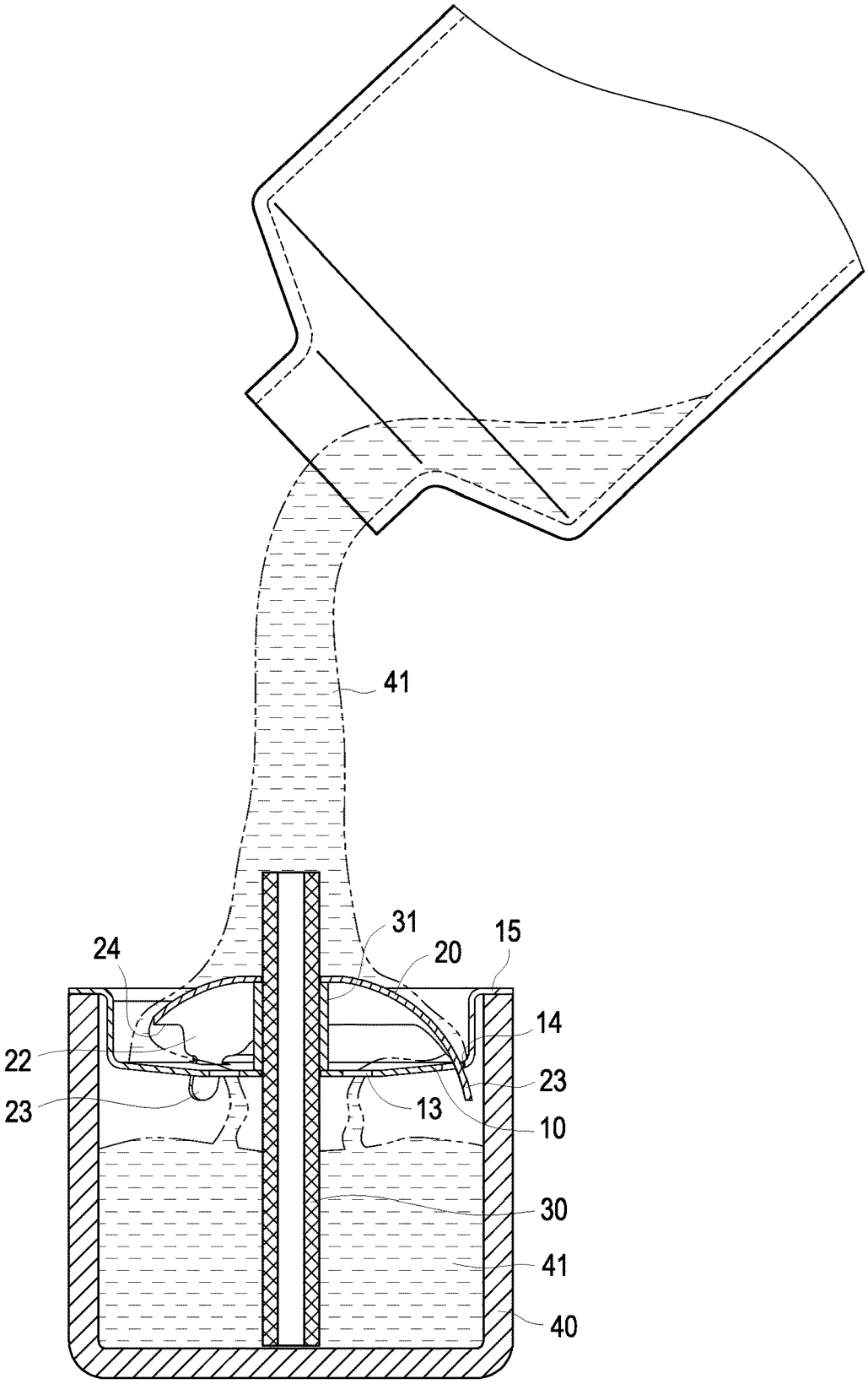
FIG. 5 is a further cross-sectional view illustrating the example of use of the present invention.

As shown in FIG. 5, in an example of use, a user may add or refill fuel into the fuel container 40 without removing the wick burning device according to the present invention, by pouring fuel 41 onto a top of the wick 30 and allowing an extra amount of fuel 41 to flow along the curved or arc surface of the heat isolation cover 20 so as to be guided to flow downward into the wick tray 10, and then passing through the heat-dissipating fuel-dropping holes 13 of the wick tray 10 to smoothly flow into the fuel container 40 located at the underside, such that a lower portion of the wick 30 that is immersed in the fuel 41 inside the fuel container 40 can quickly suck in and be filled with the fuel to generate the capillary action for continuously feeding the fuel upward along he wick 30 to an upper portion thereof, until the fuel 41 contained in the fuel container 40 is used up.

Figure 6:
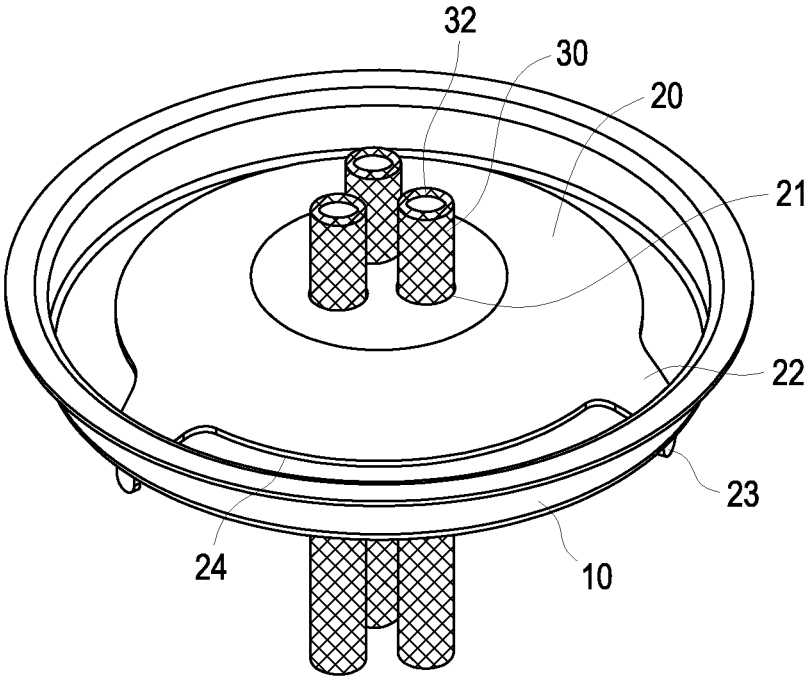
FIG. 6 is a perspective view showing an embodiment of a three-wick structure according to the present invention.
Figure 7:
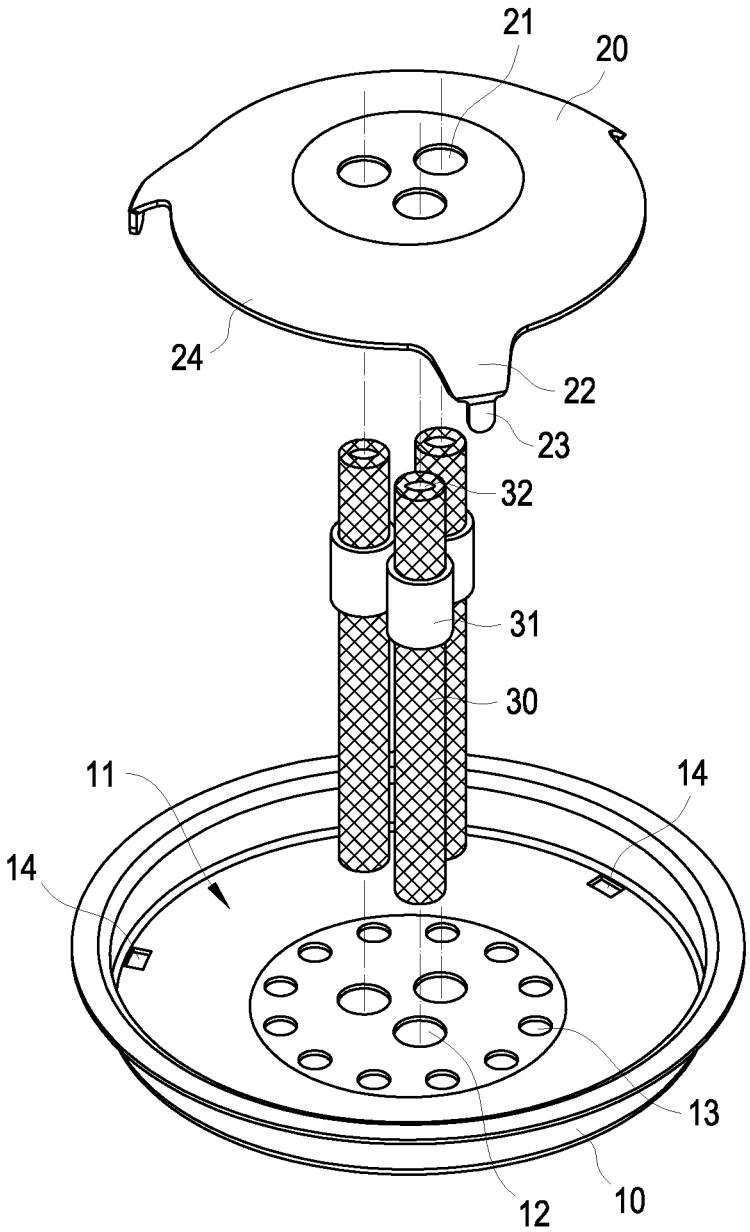
FIG. 7 is an exploded view showing the embodiment of the three-wick structure according to the present invention.

Referring to FIGS. 6 and 7, in an embodiment, a three-the wick example is provided, but it is not intended to limit the number of wick 30 that the application of the present invention the wick 30 may involve.

Mainly, the wick tray 10 is provided with three through holes 12, and the heat isolation cover 20 is provided with three through apertures 21 respectively corresponding to the through holes 12, and three wicks 30 are respectively inserted through the through apertures 21 and the through holes 12.

As such, the present invention enables a firm and secured arrangement of a plurality of wicks 30 to improve the performance of burning.

Figure 8:
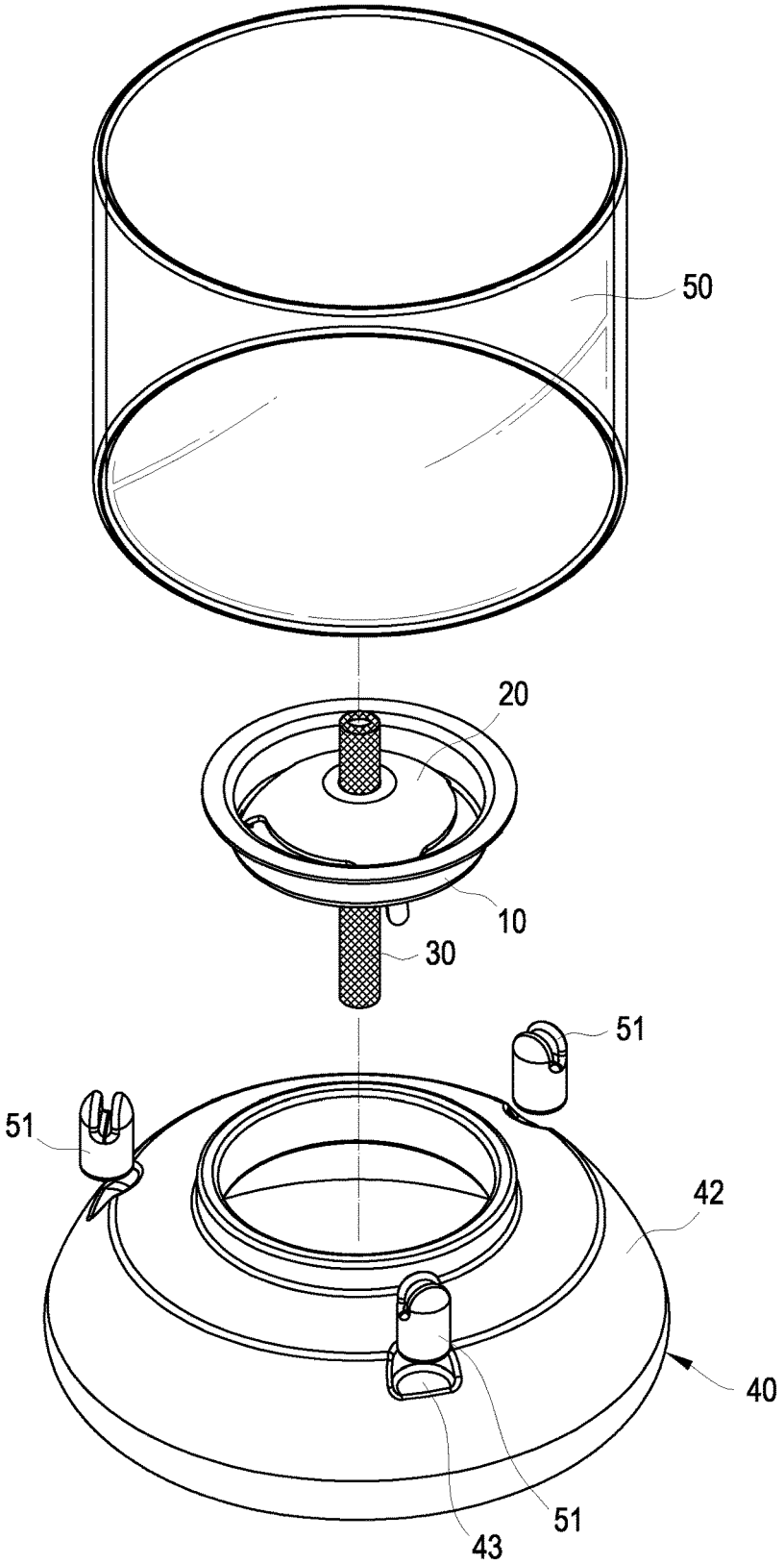
FIG. 8 is an exploded view showing a ventilation and flow-guide structure according to the present invention.
Figure 9:
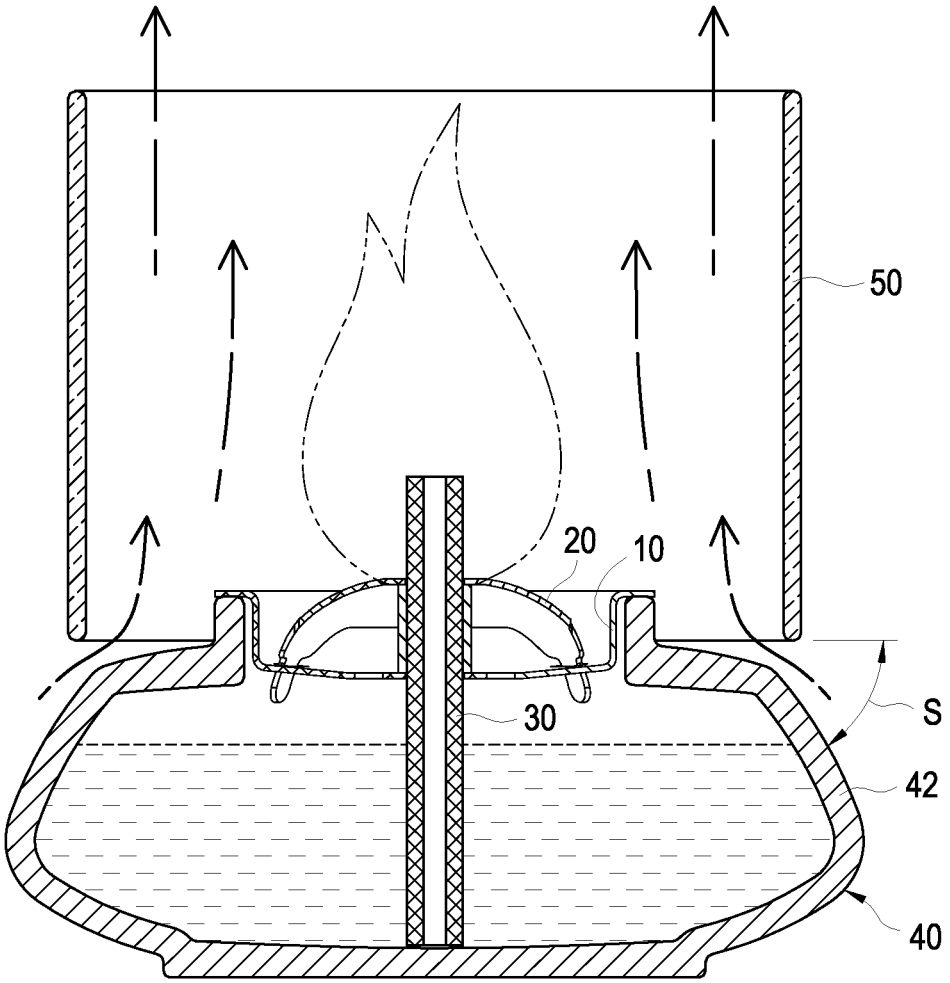
FIG. 9 is a cross-sectional view illustrating an example of use of the ventilation and flow-guide structure according to the present invention.

Referring to FIGS. 8 and 9, in an embodiment, in the present invention, the fuel container 40 comprises a wind-shielding hood 50 positioned thereon to surround and shield the wick 30. The fuel container 40 is provided, on an outside surface thereof, with a fuel-container inclination surface 42. A lower edge of the wind-shielding hood 50 and the fuel-container inclination surface 42 jointly define a ventilation and flow-guide opening S, so that an airflow is allowed to flow through the ventilation and flow-guide opening S into an interior space of the wind-shielding hood 50.

As such, the wind-shielding hood 50 not only provides an effect of shielding the wick 30 from winds, but also enables smooth ingress of air into the wind-shielding hood 50 so as to make flaming on the wick 30 stable and not jumping.

In an embodiment, the wind-shielding hood 50 is made of a light-transmitting material, such as glass, for easy and safe observation of the condition of burning of the wick 30.

In an embodiment, a top surface of the fuel container 40 is provided with a plurality of notches 43, while a plurality of elastic pads 51 are mounted to the lower edge of the wind-shielding hood 50 to be respectively corresponding to, and preferably disposed in, the notches 43, so that, by means of cushioning provided by the elastic pads 51, the wind-shielding hood 50 can be firmly and stably positioned on the fuel container 40, while easy mounting and removal of the wind-shielding hood 50 can be achieved.

The above provides illustrative embodiments of the present invention, for the purposes of illustration only, and not intended to constrain the scope of the present invention. Alternative arrangements that are contemplated from the appended claims should be considered falling in the scope of the claims of this application.

I claim:

1. A wick-burning and ventilation and flow-guide structure, comprising:

a wick tray, which comprises a recess, the recess being provided with at least one through hole, a bottom of the recess of the wick tray being provided with a plurality of heat-dissipating fuel-dropping holes and at least one mounting hole, the wick tray being positionable on a fuel container;

a heat isolation cover, which is in the form of a curved surface, the heat isolation cover being provided with at least one through aperture, the through aperture corresponding to the through hole, the heat isolation cover having a periphery that is formed with at least one support section corresponding to the mounting hole of the wick tray, the support section being extended to form a protrusion section that is receivable and positioned in the mounting hole, in order to connect the heat isolation cover to the wick tray in a removable manner and also to form a heat isolation space between the heat isolation cover and the wick tray, the periphery of the heat isolation cover being also formed with at least one opening part, which defines, together with a periphery of the wick tray, a ventilation heat-dissipating space; and a wick, which is made of a metallic or ceramic material, the wick being receivable in and extendible through the through aperture of the heat isolation cover and the through hole of the wick tray to be positioned, a flame-blocking heat-isolating sleeve being fit over and mounted to a surface of the wick between the heat isolation cover and the wick tray.

2. The wick-burning and ventilation and flow-guide structure according to claim 1, wherein the bottom of the recess of the wick tray is of a curved surface that slopes toward the heat-dissipating fuel-dropping holes and is adapted to guide a liquid fuel to flow toward and concentrate in the heat-dissipating fuel-dropping holes for smoothly flowing downward to the fuel container located on an underside.

3. The wick-burning and ventilation and flow-guide structure according to claim 1, wherein the opening part of the heat isolation cover is of a curved configuration that protrudes outward.

4. The wick-burning and ventilation and flow-guide structure according to claim 1, wherein a wind-shielding hood is positionable on the fuel container to surround and shield the wick, the fuel container having an outside surface that is provided with a fuel-container inclination surface, a lower edge of the wind-shielding hood and the fuel-container inclination surface jointly defining a ventilation and flow-guide opening, so that an airflow is allowed to flow through the ventilation and flow-guide opening into the wind-shielding hood in a uniform manner and external winds are prevented from directly blowing onto the wick.

5. The wick-burning and ventilation and flow-guide structure according to claim 4, wherein the wind-shielding hood is made of a light-transmitting material.

6. The wick-burning and ventilation and flow-guide structure according to claim 4, wherein the fuel container is provided, on a top surface thereof, with a plurality of notches, and a plurality of elastic pads are mounted to the lower edge of the wind-shielding hood and respectively corresponding to the notches, so that the wind-shielding hood are positioned by means of the elastic pads on the fuel container in a manner of easy mounting and removal of the wind-shielding hood.

* * * * *